175-48
3/3/81 XR 4,253,530 SR

United States Patent [19] [11] 4,253,530
Sharki et al. [45] Mar. 3, 1981

[54] METHOD AND SYSTEM FOR CIRCULATING A GAS BUBBLE FROM A WELL

[75] Inventors: Martin J. Sharki; William A. Rehm; Woodrow E. Renfro, all of Houston, Tex.

[73] Assignee: Dresser Industries, Inc., Dallas, Tex.

[21] Appl. No.: 82,848

[22] Filed: Oct. 9, 1979

[51] Int. Cl.[3] ..... E21B 7/00; E21B 21/08; E21B 47/06

[52] U.S. Cl. ..... 175/25; 175/38; 175/48; 175/218

[58] Field of Search ..... 175/25, 38, 218, 40, 175/48

[56] References Cited

U.S. PATENT DOCUMENTS

| | | | |
|---|---|---|---|
| 3,362,487 | 1/1968 | Lindsey | 175/38 |
| 3,443,643 | 5/1969 | Jones | 175/25 |
| 3,470,971 | 10/1969 | Dower | 175/25 |
| 3,470,972 | 10/1969 | Dower | 175/25 |
| 3,477,526 | 11/1969 | Jones et al. | 175/25 |
| 3,550,696 | 12/1970 | Kenneday | 175/25 |
| 3,677,353 | 7/1972 | Baker | 175/25 |
| 3,693,732 | 9/1972 | Sabi | 175/25 |
| 3,827,511 | 8/1974 | Jones | 175/25 |

*Primary Examiner*—Stephen J. Novosad
*Attorney, Agent, or Firm*—J. N. Hazelwood; B. E. Deutsch

[57] ABSTRACT

A gas bubble is circulated from a well by a system that maintains the well and bottom hole pressure substantially constant by progressively increasing the casing pressure as needed to maintain the drill pipe pressure substantially constant. An incrementally increasing casing pressure reference signal is produced by detecting each occurrence of the drill pipe pressure falling a predetermined amount below a drill pipe pressure reference signal. The casing pressure reference signal is compared with the actual casing pressure. A throttling valve is closed a corresponding amount if the acutal casing pressure is less than the casing pressure reference signal. The throttling valve is opened a corresponding amount if the actual casing pressure is greater than the casing pressure reference signal.

7 Claims, 6 Drawing Figures

METHOD AND SYSTEM FOR CIRCULATING A GAS BUBBLE FROM A WELL

BACKGROUND OF THE INVENTION

The present invention relates generally to the earth boring art. The invention more particularly relates to the control of pressure of drilling mud within a well when gas from the formations has intruded into the well and the gas is being circulated to the surface.

It is customary to provide a choke or throttling valve in a manifold connected with the annulus of the well beneath a blowout preventer. When the blowout preventer is closed about the drill string, the choke can establish and maintain a back pressure on the drilling mud that is being diverted through the manifold. This back pressure, together with the hydrostatic pressure of the drilling mud in the well, is intended to contain the pressured fluids within formations penetrated by the well bore, i.e., prevent them from flowing into the well bore. The choke is preferably adjustable so that, in the case of a "kick" or gas bubble, it may be regulated in an attempt to maintain a predetermined pressure differential between the bottom hole pressure of the mud and the pressure of the formation fluid as heavier mud is circulated down the drill string carrying the gas bubble up the annulus to "kill" the well. During this time, it is desirable not only to contain such fluid, but also to avoid excessive back pressure in the well which might cause the drill string to stick or damage the formations, the well casing, or the well head equipment. A significant problem that is encountered in such an operation is the time delay between the adjustment of the throttling valve at the manifold and the pressure change detected at the top of the drill pipe. The pressure change produced by the adjustment of the throttling valve must traverse the casing annulus to the bottom of the well and the interior of the drill pipe to the surface.

DESCRIPTION OF PRIOR ART

In U.S. Pat. No. 3,827,511 to Marvin R. Jones, patented Aug. 6, 1974, an apparatus for controlling well pressure is shown. Apparatus is disclosed for controlling the bottom hole pressure of a well into which a drill string extends by automatically regulating a choke at the outlet of the well.

In U.S. Pat. No. 3,677,353 to Gerald S. Baker, patented July 18, 1972, an apparatus for controlling well pressures is shown. There is disclosed an apparatus which includes a choke for connection to the annulus between a well bore and a drill string extending into the bore, and a means for operating the choke to impose a back pressure on drilling fluid in the annulus either manually or automatically in response to certain well characteristics so as to maintain a predetermined pressure differential between it and formation fluid at the bottom of the well bore.

SUMMARY OF THE INVENTION

A system is provided for maintaining a substantially constant bottom hole pressure during the circulation of a gas bubble out of a well. A reference signal is provided representing a desired drill pipe pressure. A comparator produces a control signal when a signal representing the actual drill pipe pressure and the reference signal vary by a predetermined amount. The control signal is utilized to produce a casing reference signal. A comparator system produces a valve control signal when the casing reference signal and a signal representing the actual casing pressure vary by a predetermined amount. The valve control signal is utilized to adjust a throttling valve until the casing reference signal and the signal representing the actual casing pressure are within predetermined limits. The above and other features and advantages of the present invention will become apparent from a consideration of the following detailed description of the invention when taken in conjunction with the accompanying drawings.

DETAILED DESCRIPTION OF THE INVENTION

Figure 1:
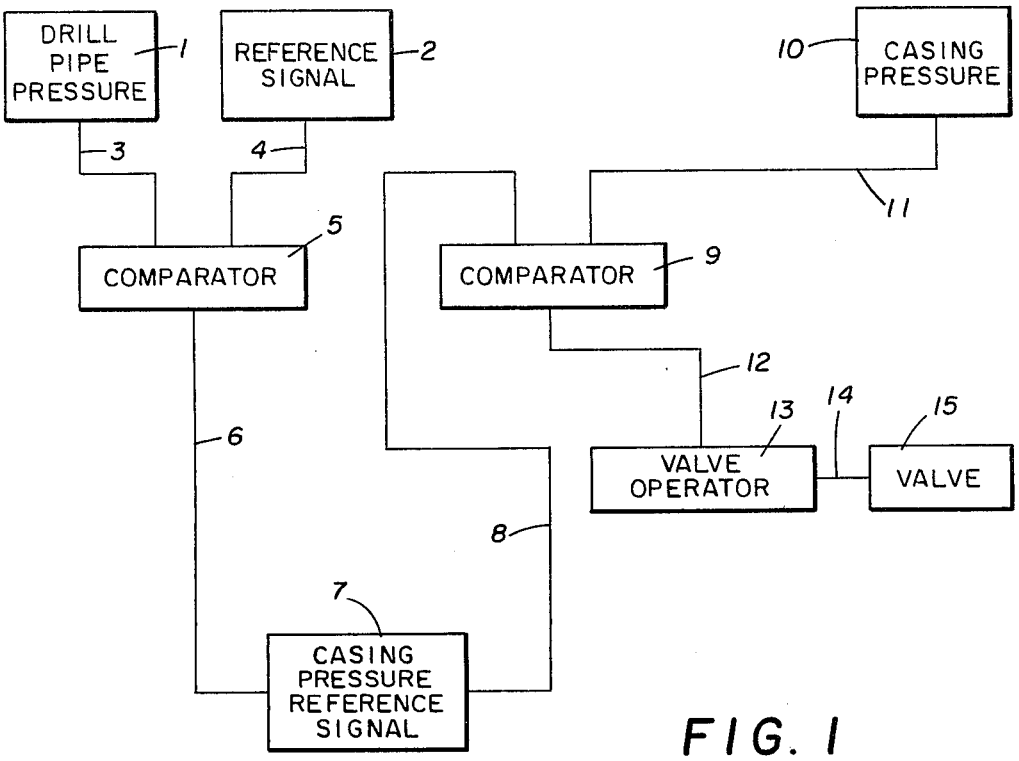
FIG. 1 is a block diagram of a system constructed in accordance with the present invention.

Referring now to the drawings, and in particular to FIG. 1, a block diagram of a system constructed in accordance with the present invention is set out. A gas bubble is circulated from a well under controlled conditions to "kill" the well. The well and bottom hole pressure is maintained substantially constant by progressively increasing the casing pressure as needed to maintain the drill pipe pressure substantially constant while maintaining an essentially constant pumping rate. A reference signal 4 is provided representing a desired drill pipe pressure at a pre-selected circulating rate. The reference signal 4 is generated by an adjustable signal generating means 2. The actual drill pipe pressure is detected by a means 1 and means 1 produces a signal 3 representing the actual drill pipe pressure.

The reference signal 4 and the drill pipe pressure signal 3 are compared by the comparator means 5. When the drill pipe pressure signal 3 falls a predetermined amount below the reference signal 4 the comparator means 5 produces a signal 6. The signal 6 is transmitted to a means 7 for producing an incrementally increasing casing pressure reference signal 8. The actual casing pressure is detected by a means 10 and means 10 produces a signal 11 representing the actual casing pressure.

The casing pressure reference signal 8 and the actual casing pressure signal 11 are compared by the comparator means 9. The comparator means 9 is connected to a means 13 for opening and closing a valve 15. The signal 12 from comparator means 9 causes the means 13 to close the valve 15 a certain amount if the actual casing pressure signal 11 is less than the casing pressure reference signal by a predetermined amount. The signal 12 from comparator means 9 causes the means 13 to open the valve 15 a certain amount if the actual casing pressure signal is more than the casing pressure reference signal by a predetermined amount.

The system maintains a substantially constant bottom hole pressure during the circulation of a gas bubble out of a well. The reference signal 4 is provided representing a desired drill pipe pressure at a selected circulating rate. The comparator 5 produces a control signal 6 when the signal 3 representing the actual drill pipe pressure and the reference signal 4 vary by a predetermined amount. The control signal 6 is utilized to produce a casing pressure reference signal 8. The comparator system 9 produces a valve control signal 12 when the casing pressure reference signal 8 and the signal 11 representing the actual casing pressure vary by a predetermined amount. The valve control signal 12 is utilized to adjust the valve 15 until the casing pressure reference signal 8 and the signal 11 representing the actual casing pressure are within predetermined limits.

Figure 2:
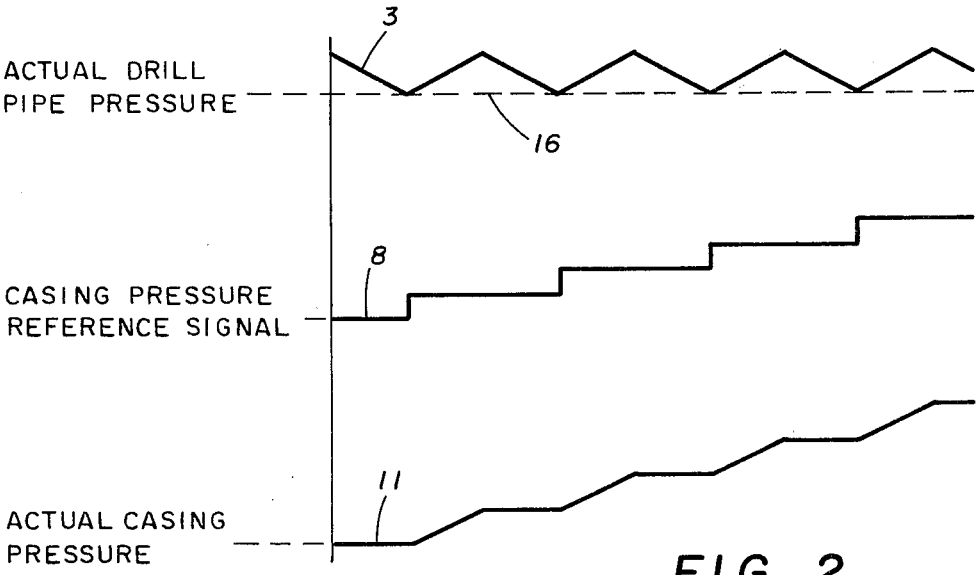
FIG. 2 illustrates the relationship between the signals at critical points in the block diagram shown in FIG. 1.

Referring now to FIG. 2, a correlation is established by the system of this invention between the actual drill pipe pressure, the casing pressure reference signal and the actual casing pressure signal. The actual drill pipe pressure as represented by the drill pipe pressure signal 3 tends to fall until it reaches a minimum pressure represented by dotted line 16. The actual drill pipe pressure then tends to increase to a peak and begins repeating in a cyclic pattern. The casing pressure reference signal 8 and the actual casing pressure as represented by the casing pressure signal 11 incrementally move upward until the gas bubble has been circulated out of the well.

Figure 3:
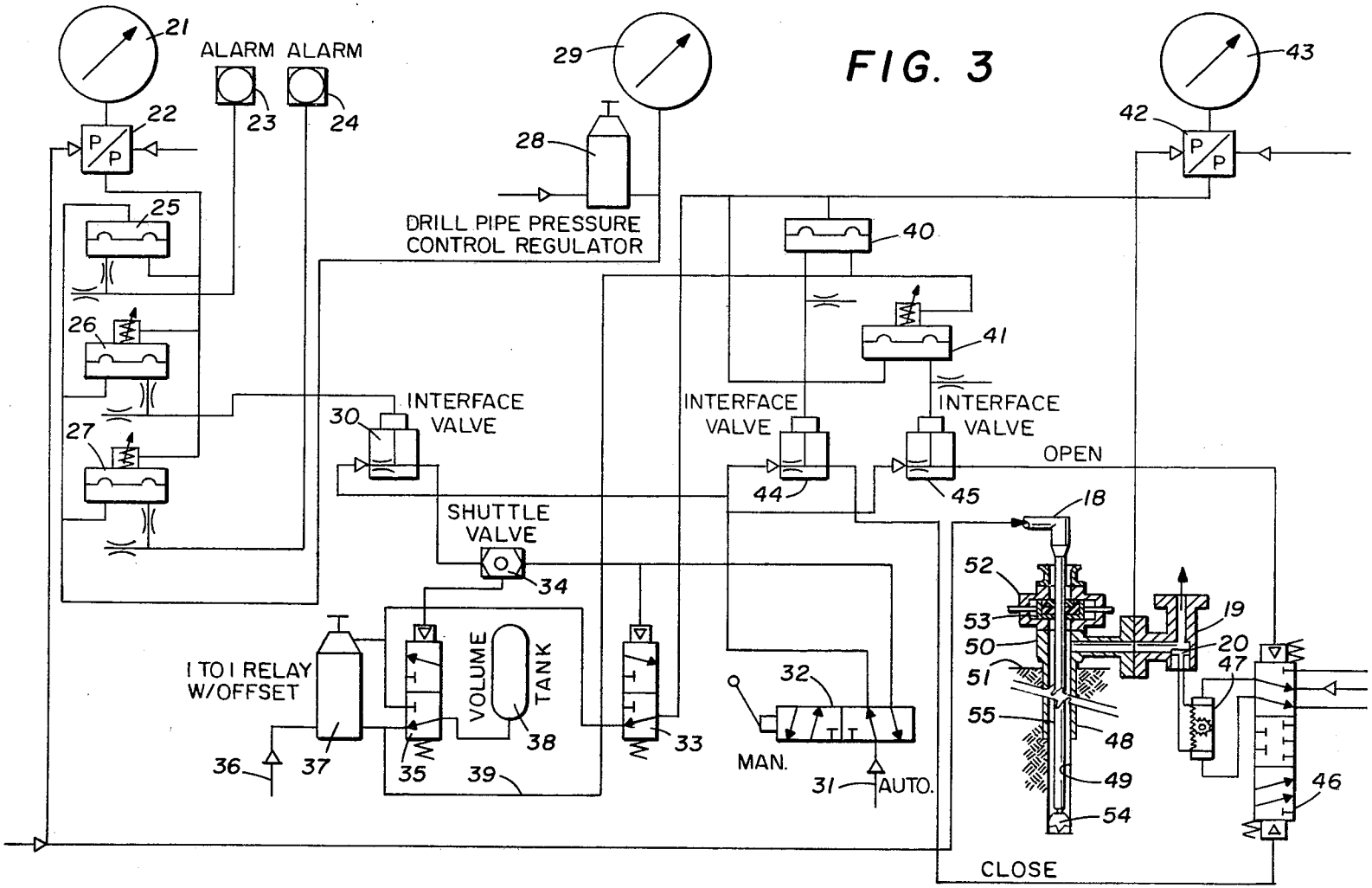
FIG. 3 is an illustration of a system constructed in accordance with the present invention.

Referring now to FIG. 3, an illustration of a system constructed in accordance with the present invention is provided. As illustrated in FIG. 3, a well on which a control apparatus is installed includes a casing 48 lining a portion of a well bore 49 and a casing head 50 connected to its upper end at the surface level 51. A blowout preventer 52 connected above the casing head 50 has a bore therethrough forming a continuation of the well bore and casing head with rams 53 mounted for reciprocation between positions opening and closing the bore.

A drill bit 54 is connected to the lower end of a drill string 55 extending through the well head and into the well bore. The bit 54 normally has orifices in the bottom thereof through which drilling fluid is jetted into the well bore and is rotated with the drill string in a well known manner. A Kelly (not shown) usually occupies a position at the upper end of the string during normal drilling operations. Drilling mud is circulated through an inlet 18 for passage downwardly through the drill string, out the orifices in the bit, and upwardly through the annulus between the string and well bore.

The bit 54 may penetrate a formation holding fluid under pressure. Normally, this formation fluid is contained within the formation by the drilling fluid circulated through the well bore. However, on occasion the drilling fluid will not contain the pressure of the formation fluid, in which case the well may "kick", as indicated by the ability of the well to flow with the pumps for circulating the drilling fluid shut down. When this occurs, the operator will shut in the well and permit the pressure to build up in the annulus and thus in the outlet leading to the choke 19. After an initial build-up, the pressure in the lower end of the well bore, and known as "bottom hole pressure", will have stabilized at a value required for containing the formation fluid. It will be understood in this respect that "bottom hole pressure" means the pressure opposite the lower end of the bit 54 at the end of the drill string, which need not necessarily be at the lower end of the well bore. In like vein, "formation fluid pressure" is formation pressure corrected, if necessary, for the hydrostatic pressure due to the fluid contained between the bit and the formation.

The choke 19 is of any conventional construction. In the embodiment shown, it includes a body having a right angle flowway therethrough and a flow restricting member 20 reciprocable therein between maximum and minimum flow restricting positions with respect to an opening intermediate the ends of the flowway. The member 20 is caused to reciprocate by means of an actuator 47 mounted on the body. The actuator 47 includes a piston. The piston is caused to reciprocate in response to fluid pressure differential across it, which is in turn responsive to signals to be described.

An accepted method of controlling an inflow of gas into a well being drilled is to provide a pressure at the bottom of the well slightly in excess of the pressure of the formation fluid. On the drill pipe part of the fluid circulating system, the bottom hole pressure is exerted against the net fluid pressure at the exit from the drill bit at the end of the drill pipe and is equal to the sum of the pump pressure at the surface and the hydrostatic head of the fluid reduced by the friction pressure loss in the drill pipe. In the annulus between the drill pipe and the bore wall or casing, the pressure at the bottom is the sum of the hydrostatic head of fluid and gas in the annulus and the surface back pressure against the variable orifice or choke plus a minor friction loss in the flow up the annulus. The usual practice requires a constant pump speed and therefore a constant friction loss in the pipe so any change in bottom pressure is apparent at the surface as an equal change in drill pipe pressure. If any gas has entered the system in the annulus, it is carried upward by the circulation and has a continuously reducing hydrostatic pressure on it, permitting it to expand and replace more fluid and further reduce the annular hydrostatic head. The total pressure may be maintained by further reducing the variable orifice and creating an additional back pressure on the system. Thus, in the normal successful procedure, the back pressure indicated on the annulus will continuously rise when a constant pressure is maintained at the bottom of the hole and the pumping pressure remains essentially constant. Any variation in the indicated pumping pressure signals a deviation from the correct variable orifice size.

In drilling wells, earlier attempts were made to control the back pressure while controlling a kick by measuring the drill pipe pressure under constant pumping rate and fluid density conditions and by signaling a change in annular back pressure followed by a constant time delay in the circuit before a new drill pipe pressure signal could cause another change. This system was unsatisfactory because the required delay factor is not itself a constant.

The embodiment of the present invention as shown in FIG. 3 uses a signal created by changes in the upstream pressure (drill pipe pressure) to provide a change in the downstream back pressure (annular pressure in the oil well usage) by changing the variable orifice enough to produce the predetermined back pressure increment or descrement. Drill pipe pressure is measured on gauge 21 and converted in pressure-to-pressure converter 22 to a 3–15 p.s.i. process signal which is directed to each of a multiplicity of pressure comparators 25, 26 and 27. The reference pressure for the drill pipe pressure comparators is supplied by the manually set drill pipe pressure control regulator 28 and is measured by gauge 29. The regulator 28 is adjusted to provide a signal pressure equal to the signal pressure from converter 22 for the desired drill pipe pressure to be maintained. Comparator 25 is set up so that when the drill pipe pressure exceeds the equivalent pressure for which the regulator 28 is set, alarm 23 will be activated. Comparator 27 may be set with an independent bias and is connected to alarm 24 to indicate a low drill pipe pressure. In practice, the bias on comparator 27 is somewhat greater than the bias on comparator 26 and may well be set at twice as much, notifying the operator that the compensatory choke action is not acting rapidly enough or by large enough steps to maintain an adequate bottom hole pressure.

If the drill pipe pressure signal is less than the reference pressure from regulator 28 by an amount equal to or more than the bias adjusted into comparator 26, a pressure signal is transmitted to interface valve 30. The interface valve 30 in turn permits pressure from source 31 through switch 32 to activate other valves in the casing pressure reference system in a manner that will be explained subsequently.

Switch 32 may be set in either the manual mode position or in the automatic mode position. In the automatic mode, air from source 31 passes through interface valve 30 only when comparator 26 activates interface valve 30, and so passes through shuttle valve 34 to activate valve 35. Valve 35, when not activated, has passed the offset pressure from one-to-one offset relay 37 to volume tank 38. When valve 35 is activated, pressure from volume tank 38 is transmitted to the input side of relay 37 and increases the input pressure by the amount of the spring offset bias. This increases the output pressure from relay 37 by the same increment. When comparator 26 ceases to pass a signal, interface valve 30 is deactivated and valve 35 returns to its deactivated position and the volume tank 38 is pressured to the new offset output of relay 37. Each successive signal from comparator 26 thus increases the offset of relay 37 by the amount of its initial spring offset bias, which new pressure is also transmitted by line 39 to the reference pressure sides of comparators 40 and 41 in the casing pressure control system. Casing pressure is applied to the pressure-to-pressure converter 42 and is displayed on gauge 43. The converter passes proportional process signal pressure to the signal pressure sides of comparators 40 and 41. If the casing pressure signal is less than the reference pressure from relay 37, comparator 40 activates interface valve 44 and pressure from source 31 through valve 32 is transmitted to activate valve 46 of the servo-loop system and operator 47 to start closing the choke in the casing line. When such closing results in an increase in casing pressure to comparator 40, interface valve 44 is deactivated and the servo-loop is deactivated. If the increased casing pressure exceeds the bias on comparator 41 plus the reference pressure from relay 37, interface valve 45 is activated which then activates valve 46 and operator 47 to begin opening the choke and decreasing the back pressure.

In the manual mode, valve 32 passes pressure to activate valve 33 and through the shuttle valve 34 to activate valve 35 continuously, which transmits the casing pressure process signal to the input side of relay 37 and to volume tank 38, maintaining a constant offset pressure on line 39 to comparators 40 and 41. Since the offset is only the initial offset pressure, comparator 40 will activate interface valve 44, but since there is no pressure available from source 31, there is no signal to valve 46. The choke can thus be operated by the normal manual methods. Thus, the initial operating condition is adjusted manually and is available on demand for changing over to automatic control.

Figure 4:
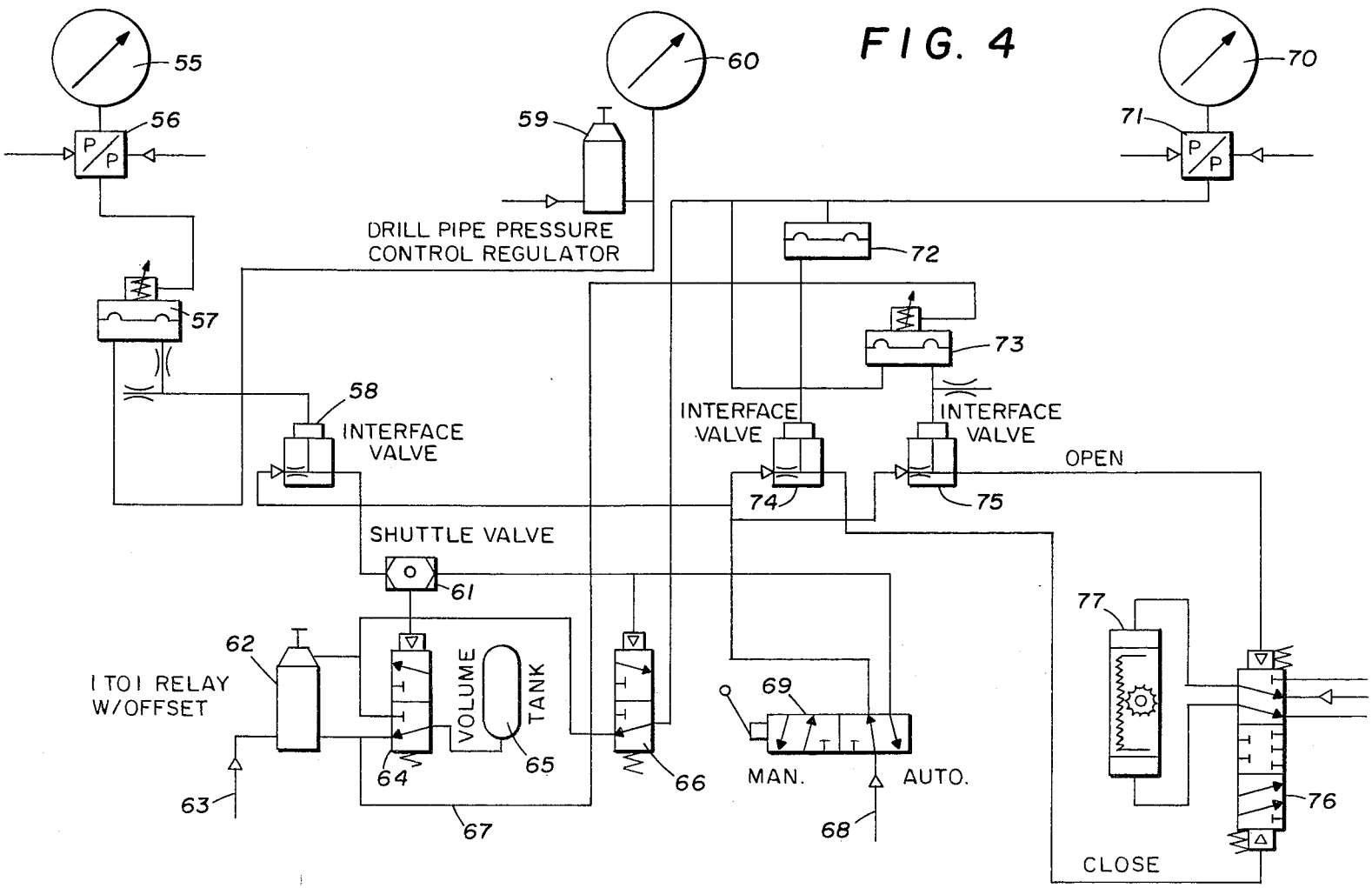
FIG. 4 is an illustration of another embodiment of the present invention.

Referring now to FIG. 4, another embodiment of the present invention is illustrated. It will be appreciated that the system shown in FIG. 4 is basically the system previously disclosed with reference to FIG. 3. The primary distinction between the embodiment of FIG. 4 and the embodiment of FIG. 3 is that the alarms shown in FIG. 3 have been deleted and the structural elements of the well and drilling equipment are not shown in FIG. 4, however, said elements and equipment are to be understood to be the same system shown in FIG. 3.

The embodiment of the invention shown in FIG. 4 uses a signal created by changes in the upstream pressure (drill pipe pressure) to provide a predetermined change in the variable orifice and so as to provide a change in the downstream back pressure (annular pressure in the oil well usage). Drill pipe pressure is measured on gauge 55 and converted in pressure-to-pressure converter 56 to a 3–15 p.s.i. process signal which is directed to the pressure comparator 57. The reference pressure for the comparator 57 is supplied by the manually set drill pipe pressure control regulator 59 and is measured by gauge 60. The regulator 59 is adjusted to provide a signal pressure equal to the signal pressure from converter 56 for the desired drill pipe pressure to be maintained.

If the drill pipe pressure signal is less than the reference pressure from regulator 59 by an amount equal to or more than the bias adjusted into comparator 57, a pressure signal is transmitted to interface valve 58 which in turn permits pressure from source 68 through switch 69 to activate other valves in the casing pressure reference system in a manner that will be explained subsequently.

Switch 69 may be set in either the manual mode position or in the automatic mode position. In the automatic mode, air from source 68 passes through interface valve 58 only when comparator 57 activates interface valve 58, and so passes through shuttle valve 61 to activate valve 64. Valve 64, when non-activated, has passed the offset pressure from one-to-one offset relay 62 to volume tank 65. When valve 64 is activated, pressure from volume tank 65 is transmitted to the input side of relay 62 and increases the input pressure by the amount of the spring offset bias. This increases the output pressure from relay 62 by the same increment. When comparator 57 ceases to pass a signal; interface valve 58 is deactivated and valve 64 returns to its deactivated position and the volume tank 65 is pressured to the new offset output of relay 62. Each successive signal from comparator 57 thus increases the offset of relay 62 by the amount of its initial spring offset bias, which new pressure is also transmitted by line 67 to the reference pressure sides of comparators 72 and 73 in the casing pressure control system. Casing pressure is applied to the pressure-to-pressure converter 71 and is displayed on gauge 70. The converter 71 passes proportional process signal pressure to the pressure signal sides of comparators 72 and 73. If the casing pressure signal is less than the reference pressure from relay 62, comparator 72 activates interface valve 74 and pressure from source 68 through valve 69 is transmitted to activate valve 76 of the servo-loop system and operator 77 to start closing the choke in the casing line. When such closing results in an increase in casing pressure to comparator 72, interface valve 74 is deactivated and the servo-loop is deactivated. If the increased casing pressure exceeds the bias on comparator 73 plus the reference pressure from relay 62, interface valve 75 is activated which then activates valve 76 and operator 77 to begin opening the choke and decreasing the back pressure. The system shown in FIG. 4 can be operated in the manual mmode in the same manner that the system shown in FIG. 3 is operated in the manual mode.

Figure 5:
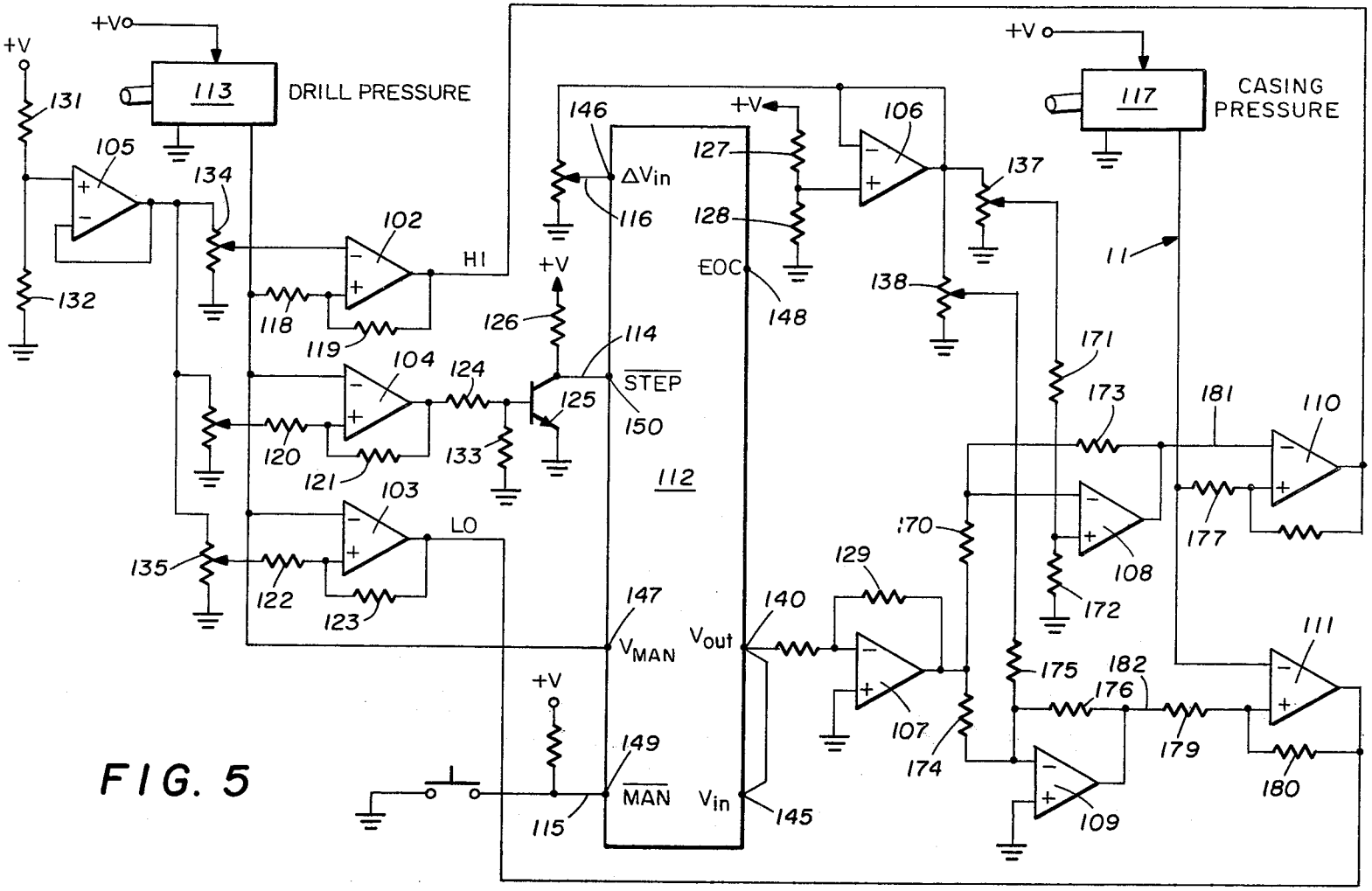
FIG. 5 is an illustration of yet another embodiment of the present invention.

Referring now to FIG. 5, an illustration of another embodiment of a system constructed in accordance with the present invention is provided. It is to be understood that a well on which a control apparatus is installed includes a casing lining a portion of a well bore and a casing head connected to its upper end at the surface level. A blowout preventer is connected above the casing head and has a bore therethrough forming a continuation of the well bore and casing head with rams mounted for reciprocation between positions opening and closing the bore. The operator can shut in the well and permit pressure to build up in the annulus and thus in the outlet leading to an adjustable choke. The choke can be of any conventional construction. It includes a body having a flowway therethrough and a flow restricting member moveable therein between maximum and minimum flow restricting positions.

A gas bubble is circulated from a well under controlled conditions to "kill" the well. The well and bottom hole pressure is maintained substantially constant by progressively increasing the casing pressure as needed to maintain the drill pipe pressure substantially constant while maintaining an essentially constant pumping rate. A reference signal is provided representing a desired drill pipe pressure at a pre-selected circulating rate. The reference signal is generated by an adjustable signal generating means. The actual drill pipe pressure is detected by a pressure transducer means 113 and means 113 produces a signal representing the actual drill pipe pressure. The reference signal and the drill pipe pressure signal are compared by a comparator means. When the drill pipe pressure signal falls a predetermined amount below the reference signal the comparator means produces a signal. The signal is transmitted to a means for producing an incrementally increasing casing pressure reference signal. The actual casing pressure is detected by a means 117 and means 117 produces a signal on line 11 representing the actual casing pressure. The casing pressure reference signal and the actual casing pressure signal are compared by the comparator means. The comparator means is connected to a means for opening and closing the choke. The system causes the choke to be closed a certain amount if the actual casing pressure signal is less than the casing pressure reference signal by a predetermined amount. The system causes the means to be opened a certain amount if the actual casing pressure signal is more than the casing pressure reference signal by a predetermined amount.

The units 113 and 117 are high pressure transducers, which convert pressure to a relative electrical voltage, typically 0–10 volts for 0 to full pressure. These are commercially available in different ranges and output voltage or current configurations, or as unamplified strain gauge signals. Transducer 113 reads drill pipe pressure through suitable buffers, transducer 117 reads casing pressure. In the electrical schematic FIG. 5, amplifier 105 derives a reference voltage from the power supply through resistor dividers 131 and 132. Potentiometric dividers 134 and 135 furnish high and low setpoints for comparators 102 and 103 respectively. Resistors 118, 119, 122 and 123 furnish positive feedback for hysterisis to prevent chattering. All comparators 102, 103, 104, 110 and 111 and amplifiers 105, 106, 107, 108 and 109 are standard op amps. For example, they could be National Semiconductor LM741 amplifiers.

Comparator 104 compares drill pipe pressure against a variable reference setpoint. As drill pipe pressure falls below the setpoint, output from comparator 104 drives transistor inverter and voltage level shifter composed of base resistor 124, leakage shunt resistor 133, transistor 125, and collector load resistor 126. The positive pulse from comparator 104 causes a $\overline{\text{STEP}}$ input to adder block 112.

Figure 6:
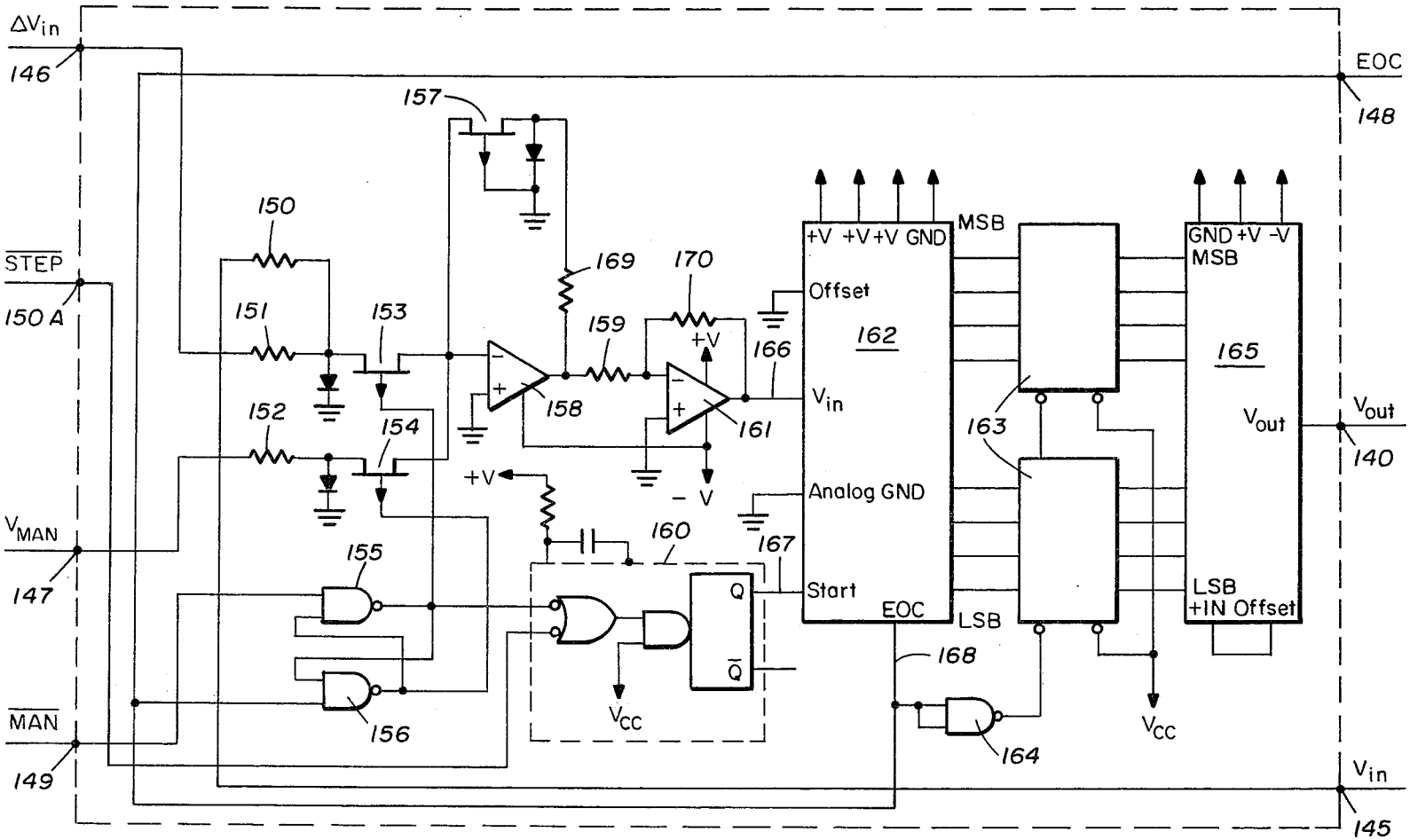
FIG. 6 is an illustration of the adder of the circuit shown in FIG. 5.

The adder is shown in FIG. 6. Power is furnished by an external power source, typically +5, +15, and −15 volts. Upon a logic low input (0–0.8 V) to $\overline{\text{MAN}}$ input 149, R-S flip flop latch composed of TTL integrated circuits (i.e. SN7400N by Texas Instruments) gates 155 and 156, turns on analog gate 154 (like National Semiconductor AH5012) and triggers one shot 160 (like Texas Instruments 74123). Voltage input $V_{man}$147 is twice algebraically inverted (i.e. two sign changes) by buffer amplifiers 158 and 161 (operational amplifiers, i.e., National Semiconductor LM741), so that $V_{man}$ appears at analog-to-digital converter (A/D) 162 input 166. The A/D is similar in function to Datel's ADC 89-8B. The one-shot 160 outputs a short pulse to A/D start terminal 167 which causes conversion. Upon completion of conversion, an EOC signal 168 is generated which, through gate 164 causes the A/D output, the digital value of $V_{man}$ to be stored in latches 163 (Texas Instruments 74175). EOC 168 also resets the R-S flip flop. As soon as it is latched, the digital value cascades through to digital-to-analog converter 165 (D/A) which is similar to Datel DAC 29-8B. The output is $V_{out}$, 140, so that it can be seen that a $\overline{\text{MAN}}$ input causes $V_{man}$ to be stored in latches and be output as $V_{out}$.

The operation of adder block 112 is as follows: Analog value is initialized by manual set input at 115. This value is usually the initial drill pipe pressure at 186, and is output at 135. As each $\overline{\text{STEP}}$ input occurs, which is a negative going edge at 114, it causes the output at 135 to become $V_{in}$ (voltage input at 136) plus the value of $\Delta V_{in}$ (the voltage at 116). If $V_{out}$ 135 is connected to $V_{in}$136, then $V_{out}$ will increase by $\Delta V_{in}$ 116, for each $\overline{\text{STEP}}$ input 114. $V_{out}$ will retain its present value until a new $\overline{\text{STEP}}$ or a manual set.

A negative-going input at $\overline{\text{STEP}}$ 150 causes one shot 160 to fire. Since R-S flip flop 155, 156 is not set, analog gate 153 is closed, and analog gate 154 is open. Therefore, currents generated by voltages $V_{in}$ 145 and $\Delta V_{in}$ 146 are summed. Operational amplifiers 158 and 161, with resistors 159, 169, and 170 causes the algebraic sum $V_{in}+\Delta V_{in}$ to appear at A/D input/166. One shot 160 output to start terminal 167 causes $V_{in}$ and $\Delta V_{in}$ to be converted and then stored similarly as described before for $V_{man}$. Thus it is seen that if $V_{in}$ is connected to $V_{out}$, each $\overline{\text{STEP}}$ input causes $V_{out}$ to be incremented by $\Delta V_{in}$.

Returning to FIG. 5, amplifier 107, resistors 129 and 130 algebraically invert the value $V_{out}$, 135. Amplifier 106, resistors 127 and 128 furnish a voltage reference for $\Delta V_{in}$, 116, and offset voltages 137 and 138. Amplifier 108 and associated resistors 170, 171, 172, and 173 generate a voltage 181, which is $V_{out}$ plus offset 137. Amplifier 109 with resistors 174, 175, and 176 is $V_{out}$ minus offset 138 at note 182. Together, voltages 181 and 182 form a window in which the casing pressure is desired to be controlled.

Comparators 110 and 111 and hysterisis resistors 177, 178, 179, and 180 are used to furnish signals to control opening and closing the choke. Not shown are the driver devices. These may take the form of electrically operated hydraulic solenoids used to operate rotary or linear actuators to operate the choke.

The embodiments of an invention in which an exclusive property or privilege is claimed are defined as follows:

1. A system for controlling the bottom hole pressure of a well, wherein a fluid is circulated therethrough to an outlet from the well, comprising: a choke for regulating pressure at the outlet, means for sensing pressure of the fluid entering the well, means for sensing the pressure of fluid leaving the well, means for comparing said sensed pressures with desired pressures including means to change a desired pressure of the fluid leaving the well in accordance with sensed changes of the fluid pressure entering the well, and means responsive to a difference between the sensed and desired pressures for operating the choke in a manner to reduce said difference.

2. A system for controlling the bottom hole pressure of a well, wherein said well has a drill string therein and fluid is circulated therethrough to an outlet from the well, comprising: a choke for regulating pressure at the outlet, means for sensing the drill string pressure of the fluid entering the well, means for sensing the pressure of fluid leaving the well, means for comparing said sensed drill string pressure with a first desired pressure and for generating a control signal indicative of changes of said difference, means for comparing the sensed pressure of fluid leaving the well with a second desired pressure, with the magnitude of said desired pressure being changed in accordance with changes in said control signal and means responsive to a difference between said sensed pressure of the fluid leaving the well and said second desired pressure for operating the choke in a manner to reduce said difference.

3. A system for circulating a gas bubble from a well utilizing the drill pipe pressure, a first reference, the casing pressure, a second reference and a throttling valve, comprising:

means for comparing the drill pipe pressure with said first reference and generating a signal when the first reference and drill pipe pressure differ a predetermined amount;

means for comparing the casing pressure with said second reference including means responsive to said signal for changing the magnitude of said second reference; and means responsive to the difference between said casing pressure and said second reference for adjusting said throttling valve and changing the casing pressure.

4. A system for circulating a gas bubble from a well having a throttling valve by utilizing the drill pipe pressure and the casing pressure, comprising:

means for detecting the drill pipe pressure and producing a drill pipe pressure signal;

means for producing a drill pipe pressure reference signal;

means for comparing said drill pipe pressure signal and said drill pipe pressure reference signal, said means producing a control signal when said signals vary a predetermined amount;

means responsive to said control signal for producing a casing pressure reference signal;

means for detecting the casing pressure and producing a casing pressure signal;

means for comparing said casing pressure reference signal and said casing pressure signal and producing a valve control signal; and means responsive to said valve control signal for adjusting said throttling valve.

5. A system for circulating a gas bubble from a well utilizing the drill pipe pressure, the actual casing pressure and a throttling valve, comprising:

means for producing a signal representing the drill pipe pressure;

means for generating a drill pipe pressure reference signal;

comparator means for determining when the drill pipe pressure falls below the drill pipe reference signal a predetermined amount, said comparator means producing a control signal;

means responsive to said control signal for producing an incrementally inceasing casing pressure reference signal;

means for producing a signal representing said actual casing pressure;

comparator means for comparing said casing pressure reference signal and said actual casing pressure signal and producing a valve control signal; and valve operator means responsive to said valve control signal for adjusting said throttling valve to provide less restriction if the actual casing pressure is higher than the casing pressure reference signal and adjusting said throttling valve to provide greater restricting if said actual casing pressure is lower than said casing pressure reference signal.

6. A method of circulating a gas bubble from a well, comprising the steps of:

providing an incrementally increasing casing pressure reference signal by detecting each occurrence of the drill pipe pressure falling a predetermined amount below a drill pipe pressure reference signal;

comparing the casing pressure reference signal with the actual casing pressure; and closing a throttling valve a corresponding amount if the actual casing pressure is less than the casing pressure reference signal and opening the throttling valve a corresponding amount if the actual casing pressure is greater than the casing pressure reference signal.

7. A method of circulating a gas bubble from a well utilizing the drill pipe pressure, the actual casing pressure, a drill pipe pressure reference signal, and a throttling valve, comprising the steps of:

providing an incrementally increasing casing pressure reference signal by detecting each occurrence of the drill pipe pressure falling a predetermined amount below the drill pipe pressure reference signal;

comparing the casing pressure reference signal with the actual casing pressure; and closing the throttling valve a corresponding amount if the actual casing pressure is less than the casing pressure reference signal and opening the throttling valve a corresponding amount if the actual casing pressure is greater than the casing pressure reference signal.

* * * * *